US005709776A

United States Patent [19]

Coleman et al.

[11] Patent Number: 5,709,776

[45] Date of Patent: *Jan. 20, 1998

[54] PROCESS FOR TREATING AND SIZING PAPER SUBSTRATES

[75] Inventors: Paul David Coleman, Sewell; John Russell Robertson, Glen Mills, both of N.J.

[73] Assignee: Imperial Chemical Industries PLC, London, England

[ * ] Notice: The term of this patent shall not extend beyond the expiration date of Pat. No. 5,605,605.

[21] Appl. No.: 756,321

[22] Filed: Nov. 25, 1996

Related U.S. Application Data

[62] Division of Ser. No. 379,045, Jan. 27, 1995, Pat. No. 5,605,605, which is a continuation of Ser. No. 136,174, Oct. 13, 1993, abandoned, which is a continuation of Ser. No. 844,346, Mar. 2, 1992, abandoned.

[51] Int. Cl.[6] ..... D21H 19/16

[52] U.S. Cl. ..... 162/135; 162/164.6; 427/475; 427/482; 427/389.9; 427/391; 427/395

[58] Field of Search ..... 162/158, 164.6, 162/135, 182; 427/475, 482, 389.9, 391, 395

[56] References Cited

U.S. PATENT DOCUMENTS

| | | | |
|---|---|---|---|
| 3,484,275 | 12/1969 | Lewicki | 117/93.4 |
| 3,492,081 | 1/1970 | Morak | 8/116.2 |
| 3,930,614 | 1/1976 | Krenkel | 239/15 |
| 3,996,154 | 12/1976 | Johnson et al. | 252/312 |
| 4,505,778 | 3/1985 | Robertson | 163/164.6 |
| 4,609,686 | 9/1986 | Giordano, Jr. et al. | 552/31 |
| 4,801,086 | 1/1989 | Noakes | 239/3 |
| 4,837,057 | 6/1989 | Bartoszek-Loza et al. | 427/388.4 |
| 4,846,407 | 7/1989 | Coffee et al. | 239/690 |
| 4,854,506 | 8/1989 | Noakes et al. | 239/691 |

FOREIGN PATENT DOCUMENTS

| | | |
|---|---|---|
| 0140537 | 5/1985 | European Pat. Off. . |
| 0193348 | 9/1986 | European Pat. Off. . |
| 2360714 | 3/1978 | France . |
| 2404571 | 8/1984 | Germany . |

*Primary Examiner*—Peter Chin

[57] ABSTRACT

A process is disclosed for strengthening and sizing paper which comprises the step of applying a composition comprising (a) an isocyanate and (b) an isocyanate-reactive component comprising at least one polyol having an ethylene oxide content of at least 1%, wherein said composition does not contain water to the paper by means of an electrostatic spraying device having a linear orifice.

22 Claims, No Drawings

PROCESS FOR TREATING AND SIZING PAPER SUBSTRATES

CROSS REFERENCE TO RELATED APPLICATIONS

The present application is a divisional of U.S. patent application Ser. No. 08/379,045, filed Jan. 27, 1995, now U.S. Pat. No. 5,605,605, which is a continuation of application Ser. No. 08/136,174, filed Oct. 13, 1993, abandoned, which in turn is a continuation of abandoned application Ser. No. 07/844,346, filed Mar. 2, 1992, abandoned.

FIELD OF INVENTION

The present invention is concerned with a process for treating and sizing paper substrates with an isocyanate. In particular, the present invention is concerned with a process for strengthening and sizing paper with a composition comprising an isocyanate and an isocyanate reactive component, characterized in that the composition does not contain water and is applied to paper by means of an electrostatic spraying device.

BACKGROUND OF INVENTION

The treatment of paper with isocyanates is known. For example, a process for treating paper with isocyanates is disclosed in EP 140537. In U.S. Pat. No. 4,505,778, a process for applying an aqueous emulsion of an aromatic isocyanate to a wet paper web is disclosed. However, the application of isocyanates to paper by conventional methods has inherent disadvantages.

Isocyanates emulsified with water have conventionally been applied to paper using a size press and unemulsified isocyanates have been applied using a rotogravure coating machine. When conventional means of spraying isocyanates are used, they are characterized by low transfer efficiencies. As a result, significant amounts of isocyanate are released into the atmosphere, thereby creating potential health problems. In addition, when the isocyanate that is applied to paper is not sprayed, solvent diluted, or emulsified, it is very difficult to apply the isocyanate at levels below 5 to 10 percent by weight based upon the weight of the paper. Lower isocyanate levels can be achieved by using emulsified isocyanates. However, pot life problems with the isocyanate can arise when the isocyanates are emulsified since the water begins to react with the isocyanate groups. Furthermore, depending upon the stage of the process at which the emulsion is added, it can result in additional drying requirements. There is therefore a need for a process for efficiently applying isocyanates to paper substrates at levels below 5 percent by weight based upon the weight of the paper substrates and a process that does not require the use of emulsified isocyanates, although emulsifiable isocyanates may be used.

Although the application of isocyanates both strengthens and sizes paper, concerns have arisen regarding possible adverse health effects which may result from isocyanate which may extract from the paper. Such concerns are particularly relevant to paper which may come into contact with food. Thus, the Food and Drug Administration (FDA) has set guidelines for amounts of any additive which may extract from paper which may be repulped into food packaging or wrap. Therefore, there also exists a need for a process which reduces the amount of isocyanate which extracts from the paper product(s) to which it is applied.

Surprisingly it has been found that these needs can be met by using an electrostatic spraying device to apply isocyanates to paper. By using this electrostatic spraying device, transfer efficiencies above 90 percent can be achieved and the isocyanate can easily be applied to paper substrates at levels well below 5 percent by weight. The amount of isocyanate needed according to the invention can be as low as 0.5 g/m$^2$. However, in commercial production settings, the amount of isocyanate applied is generally about 1.0 to 1.5 g/m$^2$.

Electrostatic spraying devices are known (see, for example, U.S. Pat. Nos. 4,854,506 and 4,846,407 and EPA-193348). The electrostatic spraying of various polymeric materials onto paper has also been disclosed in U.S. Pat. Nos. 3,930,614, 4,609,686 and 4,837,057. However, none of these patents disclose the electrostatic spraying of isocyanates onto paper.

It is therefore an object of this invention to provide a means for efficiently applying an isocyanate to a paper substrate.

It is a further object of this invention to provide a means for improving the crush strength, water resistance and wet strength of paper products.

It is an even further object of this invention to provide a means of applying a uniform coating of isocyanate onto a paper substrate.

It is yet another object to apply an isocyanate to paper in an environmentally safe manner.

It is a further object of the present invention to apply an isocyanate to paper in such a manner so as to reduce the amount of isocyanate which may extract from the paper over time.

These and other objects are obtained by the process of this invention.

SUMMARY OF INVENTION

The present invention is a process for treating a paper substrate comprising the step of applying a composition comprising (a) an isocyanate and (b) an isocyanate-reactive component comprising at least one polyol having an ethylene oxide content of at least 1%, wherein the composition does not contain water, to the paper substrate by means of an electrostatic spraying device having a linear orifice.

In a preferred embodiment, the process for treating a paper substrate comprises the step of applying a composition comprising (a) an isocyanate and (b) an isocyanate-reactive component comprising at least one polyol having an ethylene oxide content of at least 1%, wherein the composition does not contain water, to the paper substrate by means of an electrostatic spraying device which is comprised of an electrostatic sprayhead having a linear orifice, means for applying a first electrical potential to liquid isocyanate which emerges from the sprayhead, an electrode comprised of two mutually spaced, parallel arranged linear electrode elements, with one electrode element being mounted adjacent to one side of the sprayhead's orifice and the other element being mounted adjacent to the other side of the sprayhead's orifice, and means for applying a second electrical potential to the electrode such that an intense electrical field is developed between the emerging liquid and the electrode, the intensity of the field being sufficient to cause atomization of the emerging liquid, the electrode comprising a core of conducting or semiconducting material contained in a tubular sheath, characterized in that the sheath has a wall and the volume resistivity of a section of the wall of said sheath which is 1 cm in length is within the range of $5\times10^{11}$ to $5\times10^{13}$ ohm cms.

In a preferred embodiment, the present invention is directed to a process for treating paper comprising the application to a paper substrate of a composition comprising an isocyanate and an aliphatic tertiary amine-initiated polyol. In its most preferred embodiment, the present invention is directed to a process for treating paper comprising applying to a paper substrate a composition comprising an isocyanate and an ethylene diamine-based polyol.

The process of this invention provides light weight, uniform coatings of isocyanates on paper substrates and improves some of the physical properties of coated paper substrates, such as water resistance, wet strength and crush strength. The present process provides paper substrates treated with isocyanates which meets or exceeds FDA requirements regarding extraction of the isocyanates.

DETAILED DESCRIPTION OF INVENTION

The present process involves the electrostatic spraying of isocyanates onto paper substrates. The electrostatic spraying device employed to spray isocyanates onto paper substrates preferably comprises an electrostatic sprayhead having a linear orifice, means for applying a first electrical potential to liquid isocyanate which emerges from the sprayhead, an electrode comprised of two mutually spaced, parallel arranged linear electrode elements, with one electrode element being mounted adjacent to one side of the sprayhead's orifice and the other element being mounted adjacent to the other side of the sprayhead's orifice, and means for applying a second electrical potential to the electrode such that an intense electrical field is developed between the emerging liquid and the electrode, the intensity of the field being sufficient to cause atomization of the emerging liquid, the electrode comprising a core of conducting or semiconducting material contained in a tubular sheath, characterized in that the sheath has a wall and the volume resistivity of a section of the wall of said sheath which is 1 cm in length is within the range of $5\times10^{11}$ to $5\times10^{13}$ ohm cms. Such a device and its operating parameters have been fully described in U.S. Pat. No. 4,854,506, which is incorporated herein by reference in its entirety.

Generally, as the liquid isocyanate passes through the linear orifice of the device, the isocyanate is charged at 30 to 40 kV by the means for applying an electrical potential to the isocyanate. Preferably, the isocyanate is positively charged. Once the liquid isocyanate is charged, it breaks into droplets having diameters typically ranging from 40 to 150 microns in an electric field created between the charged liquid and the electrode comprised of the two linear electrode elements, which are usually charged between 10 kV and 25 kV and at the same polarity as the liquid. Generally, the voltage difference between the liquid isocyanate and the electrode comprised of the two linear electrode elements is between 15 and 30 kV. This voltage difference is called "stress."

The isocyanates that are employed should have a viscosity in the range of 1 to 750 mPa.s, preferably in the range of 1 to 300, and a volume resistivity in the range of $1\times10^{6}$ to $1\times10^{11}$ ohm cms, preferably in the range of $5\times10^{6}$ to $5\times10^{9}$, and most preferably in the range of $5\times10^{7}$ to $5\times10^{8}$ ohm cms. Generally, the higher the viscosity of the isocyanate, the more difficult it is to apply the isocyanate.

Any isocyanate having one or more isocyanate groups and a viscosity and a resistivity between the above indicated limits can be employed. The isocyanates which may be used include aliphatic, cycloaliphatic, araliphatic and aromatic isocyanates, especially those that are liquid at room temperature. Aromatic isocyanates, especially aromatic polyisocyanates, are preferred. Mixtures of isocyanates can be used and also isocyanates which have been modified by the introduction of urethane, allophanate, urea, biuret, amide, carbodiimide, uretonimine or isocyanurate residues may be used.

Examples of suitable aromatic isocyanates include m- and p-phenylenediisocyanate, toluene-2,4- and 2,6-diisocyanates, diphenylmethane-4,4'diisocyanate (MDI), diphenylmethane-2,4'-diisocyanate, chlorophenylene-2,4-diisocyanate, diphenylene-4,4'-diisocyanate, 4,4'-diisocyanate-3,3'-dimethyldiphenyl, 3-methyldiphenylmethane-4,4'-diisocyanate and di-phenyl-etherdiisocyanate and 2,4,6-triiso-cyanatotoluene and 2,4,4'-triisocyanatodiphenylether. The most preferred aromatic isocyanates are polymeric MDI, emulsifiable MDI, MDI variants, and mixtures thereof. Suitable MDI variants include compounds in which the MDI has been modified by the introduction of urethane, allophanate, urea, biuret, amide, carbodiimide, uretonimine and/or isocyanurate residues.

There may be present mixtures of isocyanates for example a mixture of toluene diisocyanate isomers such as the commercially available mixtures of 2,4- and 2,6-isomers and also the mixture of di- and higher isocyanates produced by phosgenation of aniline/formaldehyde condensates. Such mixtures are well known in the art and include the crude phosgenation products containing mixtures of methylene bridged polyphenylpolyisocyanates including diisocyanate, triisocyanate and higher polyisocyanates together with any phosgenation by-products.

Examples of suitable aliphatic polyisocyanates include ethylene diisocyanate, 1,6-hexamethylene diisocyanate, isophorone diisocyanate, cyclohexane 1,4-diisocyanate, 4,4'-dicyclohexylmethane diisocyanate, saturated analogues of the above mentioned aromatic isocyanates, mixtures thereof and the like.

Preferred compositions of the present invention are those wherein the isocyanate is an aromatic diisocyanate or polyisocyanate of higher functionality in particular crude mixtures of methylene bridged polyphenylpolyisocyanates containing diisocyanate, triisocyanate and higher functionality polyisocyanates. The methylene bridged polyphenylpolyisocyanates are sometimes referred to as polymeric methylene polyphenyldiisocyanate (MDI). Polyphenylpolyisocyanates are well known in the art and usually have an isocyanate functionality ranging from 2.0 to 3.0. They are prepared by phosgenation of corresponding mixtures of polyamines obtained by condensation of aniline and formaldehyde.

Isocyanate-terminated prepolymers may also be employed and are prepared by reacting an excess of polyisocyanate with polyols, including aminated polyols or imines/enamines thereof, or polyamines.

Emulsifiable isocyanates may also be employed. An emulsifiable isocyanate is an isocyanate/isocyanate prepolymer blend which is made by incorporating into an isocyanate a prepolymer formed by reacting monoalkyl ethers of polyalkylene glycols or polyester polyether glycols with a polyisocyanate to form an isocyanate terminated urethane adduct. Such blends are well known to be emulsifiable in water. Suitable emulsifiable isocyanates and their preparation are described in U.S. Pat. Nos. 3,996,154 and 4,505,778, which are incorporated herein by reference. Of the emulsifiable isocyanates, emulsifiable MDI is the most preferred.

If the isocyanate to be used is a solid at the temperature of spraying, which temperature generally is 10° to 30° C.

and preferably 20° to 25° C., the isocyanate may be heated in order to liquefy it and the heated isocyanate can be sprayed. However, the isocyanate should generally not be heated to temperatures above 38° C. before being sprayed. Preferably the isocyanate is liquid at the spraying temperature.

The second component of the present compositions is an isocyanate-reactive component comprising at least one polyol having an ethylene oxide content of at least 1%. Preferably, the ethylene oxide content is from about 1 to about 90%, more preferably about 5 to about 60% and most preferably about 10 to about 40%. The ethylene oxide content refers to the amount of ethylene oxide utilized in the preparation of the polyol. During production, some ethylene oxide reacts with the initiator.

The polyol provides an ethylene oxide content in the total composition of about 0.01 to about 27%, preferably about 0.35 to about 12% and most preferably about 1 to about 8%. This amount of ethylene oxide is the total amount in the final composition. It has been found that the polyol may contain any amount of propylene oxide.

Examples of polyols suitable for use in the present invention include polyethylene ether glycol, methoxy polyethylene ether glycol, polyethylene polypropylene ether copolymers, polyethylene ether-capped polyesters and amine initiated polyols such as amine-initiated polyethylene ether polyols.

Preferably, the isocyanate-reactive component used in the present invention comprises at least one aliphatic tertiary amine-initiated polyol having an ethylene oxide content of at least 1%. Suitable aliphatic tertiary amine-initiated polyols are the known alkoxylation products of amines or aminoalcohols with at least two active hydrogen atoms with ethylene oxide and/or propylene oxide. Suitable initiator molecules include: ammonia, ethylene diamine, hexamethylene diamine, methyl amine, diaminodiphenyl methane, aniline, ethanolamine, diethanolamine, N-methyl diethanolamine, tetrahydroxyl ethyl ethylenediamine, etc. Suitable aliphatic tertiary amine-initiated polyols are those wherein the initiator comprises about 1 to about 18 and preferably about 1 to about 6 carbon atoms. Suitable aliphatic tertiary amine-initiated polyols have an average molecular weight of about 1500 to about 10,000 and preferably 1500 to about 6000 and an average OH functionality of about 1.8 to about 6.0.

The concentration of nitrogen in the amine-initiated polyol should be about 0.002 to about 0.02 eqN/100 g, preferably about 0.004 to about 0.008 eqN/100 g and most preferably about 0.006 eqN/100 g.

Preferred aliphatic tertiary amine-initiated polyols for use in the present invention include those prepared from ethylene diamine, triethylene diamine and triethanolamine.

The present compositions comprise component (b) in an amount of about 1 to about 30%, preferably about 7 to about 20% and most preferably about 10 to about 20% by weight based upon the total amount of isocyanate and polyol in the composition.

In its most preferred form, the polyol component is an ethylene diamine-based polyol containing ethylene oxide. Suitable ethylene diamine-based polyols are those having an ethylene oxide content of about 1 to about 90%, preferably about 5 to about 60%, and most preferably about 10 to about 40%. The ethylene oxide content refers to the amount of ethylene oxide utilized in the preparation of the polyols as discussed above. During production, the ethylene oxide reacts with the initiator. The polyols should have a molecular weight in the range of about 1500 to 5000.

Suitable ethylene diamine-based polyols useful in the present compositions include those of the following formula:

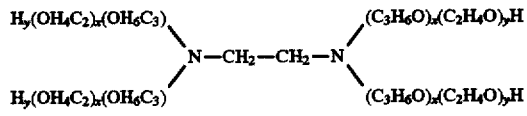

wherein x is an integer of about 1.0 to about 29.0, preferably about 4.0 to about 20 and most preferably about 4.0 to about 14; and y is an integer of about 0.1 to about 10.0 and preferably about 2.0 to about 4.0. Suitable ethylene diamine-based polyols are available commercially, such as the "Synperonic T" series of polyols available from ICI Americas Inc.

The present compositions are applied to the paper being treated in the following manner. The composition is placed into a vessel from which the isocyanate can be pumped into the sprayhead of the electrostatic sprayer. Generally a hose connects the vessel and the electrostatic sprayer. The vessel is usually equipped with or connected to a means for pumping the isocyanate to the sprayhead at variable flow rates. The flow rate can vary from 0.5 to 75 g/minute/cm of nozzle width, and preferably is in the range of 1.5 to 30 g/minute/cm of nozzle width. The selected flow rate will depend upon factors such as how much isocyanate is to be applied to the paper substrate and the speed at which the paper substrate is passing below the nozzle of the sprayer.

The composition can be applied to the paper substrate in an amount of about 0.1 to about 25.0%, preferably about 1.0 to about 20% and most preferably about 1.0 to about 10.0% by weight. After application, the treated paper substrate is cured at temperatures of from about 200° to about 400° F. and preferably about 250° to about 350° F. for a period of 1–40 minutes and preferably 1 to 10 minutes.

A wide variety of paper substrates can be treated according to the process of this invention. The process can be used to strengthen and size paper, corrugated paper containers, paper labels and paperboard. The process is especially useful in strengthening and sizing corrugated paper containers, such as containers that are likely to come into contact with moisture.

The paper substrate, when being sprayed, needs to be in contact with a conducting surface in order to prevent the paper substrate from building up a charge due to the deposition of charged isocyanate particles on the surface of the paper substrate. If a charge builds up on the surface of the paper substrate, the charge will repel charged isocyanate particles thereby leading to reduced transfer efficiencies and a non-uniform coating of isocyanate on the paper substrate. In practice the paper substrate is usually in contact with a metal roller over which the paper substrate passes. However, when individual paper articles are being treated, they can be passed under the nozzle while in contact with a flat metal plate or sheet, such as a sheet of aluminum foil.

Preferably, the nozzle is wider than the width of the paper substrate being sprayed so as to insure that the entire surface of the substrate is coated with isocyanate. The distance of the nozzle from the surface of the paper substrate should be in the range of 7 to 23 cm. If the nozzle is too close, there can be sparking between the nozzle and the conducting surface in contact with the paper substrate. Also, a striped spray pattern may be produced on the substrate. On the other hand, if the distance is greater than 23 cm, the charged isocyanate particles tend to spread out and wander thereby lowering the transfer efficiency and making it difficult to have a uniform coating on the paper substrate.

It is important to insure that objects surrounding the nozzle of the spraying device not be too close to the nozzle. The reason is that surrounding objects that are too close to the nozzle will compete with the paper substrate for the charged isocyanate particles and thereby reduce transfer efficiencies. As a result, surrounding objects should generally be kept away from the nozzle at a distance at least four times the distance between the nozzle and the paper substrate.

The paper substrate can be treated on one side or both sides. If treated on both sides, it is preferred for the isocyanate coating of the first treated side to be cured before treating the second side.

Since the isocyanates can be applied to paper substrates without being emulsified, it is not necessary to expose the substrate to a heat treatment step in order to drive off water that is used to emulsify isocyanates. Nevertheless, it is preferred to include a heat treatment step in the process of this invention because heating the paper substrate after the isocyanate is applied promotes curing and can have a beneficial effect upon some of the physical properties of the coated paper substrate, such as crush strength. When a heat step is included, the paper substrate is usually exposed to a temperature in the range of 65° to 205° C. for about 1 to 30 seconds. The heat treatment of the paper substrate usually takes place in an oven through which the substrate is passed.

Additives which are compatible with the isocyanate and isocyanate reactive compound can be mixed with the composition prior to applying the isocyanate to the paper substrate. For example, propylene carbonate can be added to the isocyanate to modify the viscosity of the isocyanate. However, too much propylene carbonate should not be added because the propylene carbonate tends to lower the resistivity of the isocyanate.

By using the process of this invention to treat paper substrates, the physical properties of the substrates can be improved. For example, the water resistance, the wet strength, and the crush strength of the substrates can be increased by using the process of this invention. The process also results in a uniform distribution of isocyanate on the paper substrates. Since charged particles are employed in the process and the particles seek to ground themselves instead of floating around in the atmosphere, the process results in greatly reduced levels of isocyanate in the atmosphere compared to conventional methods of applying isocyanates to paper substrates. Conventional spray techniques release so much isocyanate into the atmosphere that the process must be enclosed with high air extraction.

The present composition has been found to be particularly advantageous in reducing the amount of isocyanate which will extract from the treated paper, thereby producing paper which meets Food and Drug Administration (FDA) requirements. In general, the FDA has set guidelines requiring additive extraction from paper to be undetected down to 50 parts per billion or less in a suitable food simulation solvent. In paper which may be re-pulped and therefore which may ultimately come in contact with food, such as food packaging or wrap in which isocyanate extraction has been a concern, these compositions are quite useful. Although not wishing to be bound to any single theory, it is believed that the isocyanate-reactive component prevents or minimizes extraction of the isocyanate by attaching to the isocyanate molecules and by catalyzing the isocyanate. The ethylene diamine-based polyol is not extractable itself and attracts water into the system which further limits isocyanate extraction.

The invention is illustrated, but not limited, by the following examples.

EXAMPLES

Example 1

1. The electrostatic spraying device used was a device according to U.S. Pat. No. 4,854,506 having a linear orifice and the following characteristics:

the device was equipped with a linear nozzle spraying blade having a width of about 50 cm (20 inches)

the device was equipped with two field adjusting electrodes, which were two semi-conducting rods and which were placed parallel to the linear nozzle orifice at both sides.

Rubinate XI-241, which is polymeric MDI, is available from ICI Americas Inc. or Rubicon Inc., has a viscosity of 200 mPa.s, has a volume resistivity of $1\times10^8$ ohm cms and is liquid at room temperature, was placed into a pressure vessel which was connected to the electrostatic spraying device.

The liquid isocyanate was delivered to the device from the pressure vessel using air at about 80 pounds/inch$^2$. The air pressure was regulated by means of a pressure regulator so as to give a flow rate of 40 g/min or 0.8 g/minute/cm of nozzle width. The pressure was about 12 pounds/inch$^2$. Once the linear nozzle spraying blade was completely wetted with isocyanate and the isocyanate was dripping off the blade, the power to the nozzle and the field adjusting electrodes was turned on so as to give a charge of −38 kV on the nozzle and a charge of −13kV on the field adjusting electrodes.

A 60×60 cm (2×2 ft) piece of 40 lb/1000 ft$^2$ linerboard was then manually passed under the nozzle of the electrostatic spraying device. The nozzle was about 12.5 cm (5 inch) above and perpendicular to the paper. The paper was in contact with a steel plate while the paper passed beneath the nozzle to simulate paper going over a roller. After being coated on one side, the paper was allowed to cure for 24 hours at room temperature. It was then passed under the nozzle to coat the other side of the paper. The amount of isocyanate applied to the paper was 3.6% by weight calculated on the paper weight.

The physical properties of the treated paper were tested and are set forth in Table I. The treated paper had excellent water resistance and wet strength compared to an untreated piece of paper and had improved crush strength as well.

2. Example 1 was repeated except that 10% by weight of propylene carbonate was added to the polyisocyanate. The amount of this composition applied to the paper calculated on the weight of paper was 3.5% by weight. The physical properties of the paper were tested and the results are set forth in Table I.

3. The electrostatic spraying device of claim 1 was used to treat paper on a conventional paper coating machine. A Carrier Ross roll coater machine was equipped with the electrostatic spraying device of claim 1 so that the paper would be sprayed prior to entering an oven. The nozzle was situated six inches directly above a metal roller so that the paper would be in contact with the metal roller at the point where the isocyanate was sprayed onto the paper. A roll of 65 lb/3000 ft$^2$ bag paper comprised of 20 percent recycled newspaper was placed on the Carrier Ross machine and fed underneath the nozzle of the spraying device at a rate of 230 feet per minute.

The isocyanate sprayed onto the paper was Rubinate XI-242, which is a water emulsifiable MDI, is available from ICI Americas Inc. and Rubicon Inc., has a viscosity of 250 mPa.s, and has a volume resistivity of $5\times10^7$ ohm cms. The charge on the isocyanate was −37.1 kV and the charge on the field adjusting electrodes was −18.1 kV. The flow rate of the isocyanate was 40 g/min or 0.8 g/minute/cm of nozzle width. After being sprayed with the isocyanate, the paper was run through a 121° C. oven to react the isocyanate. The amount of isocyanate applied to the paper was about 1 percent by weight based upon the weight of the paper.

After being treated with the isocyanate, the physical properties of the paper were tested. The paper had improved crush strength and exhibited a dramatic increase in water resistance and wet strength compared to an untreated piece of paper.

TABLE I

| Isocyanate | None | MF-184 | MF-184 with 10% propylene carbonate |
|---|---|---|---|
| [1]MD Tear (g) | 444 | 416 | 424 |
| [2]CD Tear (g) | 496 | 452 | 412 |
| Burst (psig) | 71.2 | 96 | 86.3 |
| Wet Burst (psig) | 30.7 | 36.5 | 36 |
| CD Ring Crush (lb) | 72.6 | 91 | 93 |
| CD Ring Crush (90% RH) (lb) | 36.9 | 52.4 | 51 |
| MD Tensile Wet (lb/in) | 3.82 | 21.3 | 27.5 |
| CD Tensile Wet (lb/in) | 2.32 | 9.79 | 12.3 |
| Cobb Size ($g/m_2$) | 62.9 | 4.88 | 4.25 |

[1]MD = Machine Direction
[2]CD = Cross Direction

Example 1 demonstrates that treating paper substrates with isocyanates leads to dramatic improvements in the water resistance and wet strength as well as improvements in the crush strength of the paper substrates.

Example 2

In the following Example, Sample Nos. 1–10 were sprayed onto a paper substrate with the electrostatic sprayer identified in Example 1. Sample Nos. 1–5 contained Rubinate® 1780, an emulsifiable MDI available from ICI Americas Inc., having an ethylene oxide content of 3%. Sample Nos. 6–10 contain 3% of the above-identified Rubinate® 1780 and 0.5% of "Synperonic" T304, an ethylene diamine based polyol available from ICI Americas Inc.

Comparative Sample No. 1 contains Rubinate® M, a standard polymeric MDI available from ICI Americas Inc., which does not contain ethylene oxide.

The MDI utilized in Sample Nos. 1–10 and Comparative Sample No. 1 was prepared with $C^{14}$-tagged formaldehyde in a manner so that the target activity level was reached with 0.5 micrograms of radiolabelled material per square inch of exposed paper substrate. The radiation level was based upon the detection of 50 parts per billion in the final amount of extract solution.

The radiolabelled polymeric MDI was characterized by GPC techniques to ensure that it matched standard polymeric MDI. The radiolabelled polymeric MDI was then mixed with a larger batch of unlabelled Rubinate® 1780 until the desired quantities and radioactivity were achieved. Samples of polymeric MDI "spiked" with the correct amount of radiolabelled material were compared to the larger, diluted batch to ensure the dilution rate for the radiolabelled material was correct.

Two paper substrates were used in this experiment: (1) a brown paper (commercial linerboard) with a base weight of 42 lbs/1000 sq. ft; and (2) a white paper which was a commercial clear water leaf, having a base weight of 47 lb/3000 sq. ft. The brown paper was from Weyerhaueser Corporation and the white paper was from James River Corporation. The water content of each sample substrate was varied as identified in Table II. The water content of the paper substrate was varied by spraying water on the sheets and weighing them to verify the water content listed in Table II. The water content reflects relative amounts and not actual moisture contents.

Samples Nos. 1–10 were applied to the paper substrate samples by electrostatic spraying in an enclosed glove box. Each sheet of paper substrate was mounted with tacks on cardboard in the box. A fan-driven extraction system was used to maintain negative pressure in the box during spraying. Each sheet was weighed and the amount of Sample Nos. 1–10 to be added to obtain the resin content specified in Table II per each sample was calculated.

Each sheet was repeatedly sprayed and weighed until the correct amount of resin was applied to the paper. The sheets were then cured in a convection oven. The cure time and temperature for each sample are set forth in Table II. The treated sheets were removed from the oven and allowed to equilibrate for 2 hours at ambient room temperature.

The treated paper substrates were tested for the amount of extraction according to ASTM-AOAC Method 964.15 "Extractives from Flexible Barrier Materials". The results are set forth in Table II.

TABLE II

| Sample | Resin Content | Cure Temp. (°F.) | Cure Time | Water Content | Counts |
|---|---|---|---|---|---|
| 1 | 20% | 220 | 7 | 0 | 15,669 |
| 2 | 20% | 220 | 40 | 0 | abandoned[1] |
| 3 | 20% | 220 | 20 | 20 | 13,756 |
| 4 | 20% | 220 | 7 | 100 | abandoned[1] |
| 5 | 20% | 220 | 40 | 100 | 11,298 |
| 6 | 5% | 290 | 20 | 20 | 534 |
| 7 | 20% | 350 | 7 | 100 | 3476 |
| 8 | 20% | 220 | 7 | 0 | 12,925 |
| 9 | 20% | 220 | 20 | 20 | 3932 |
| 10 | 20% | 220 | 40 | 100 | 5625 |
| Comp. Sample 1 | 20% | 220 | 7 | 0 | 21,298 |

[1]= Tests resulting in greater than 16,000 counts were abandoned.

As can be seen from the results set forth above, the use of an emulsifiable polymerized MDI, i.e., a composition containing a polyisocyanate and a polyol having an ethylene oxide content of at least 1%, (Sample Nos. 1–5), results in significantly lower extraction of the isocyanate from the treated paper in comparison to conventional polymeric MDI (Comparative Sample 1) used under the same conditions. Moreover, the use of a polyol initiated with an aliphatic tertiary amine containing material (i.e., an ethylene diamine-based polyol) with the polyisocyanate further lowered the amount of extraction (Samples 6–10).

The present invention may be embodied in other specific forms without departing from the spirit or essential attributes thereof and, accordingly, reference should be made to the appended claims, rather than to the foregoing specification, as indicating the scope of the invention.

What is claimed is:

1. A process for treating a paper substrate comprising the step of applying a composition comprising (a) an isocyanate and (b) an isocyanate-reactive component comprising at least one polyol having an ethylene oxide content of at least 1%, wherein said composition does not contain water, to the paper substrate by means of an electrostatic spraying device having a linear orifice.

2. A process for treating a paper substrate comprising the step of applying a composition comprising (a) an isocyanate and (b) an isocyanate-reactive component comprising at least one polyol having an ethylene oxide content of at least 1%, wherein said composition does not contain water, to the paper substrate by means of an electrostatic spraying device which is comprised of an electrostatic sprayhead having a linear orifice, means for applying a first electrical potential to liquid isocyanate which emerges from the sprayhead, an electrode comprised of two mutually spaced, parallel arranged linear electrode elements, with one electrode element being mounted adjacent to one side of the sprayhead's orifice and the other element being mounted adjacent to the other side of the sprayhead's orifice, and means for applying a second electrical potential to the electrode such that an intense electrical field is developed between the emerging liquid and the electrode, the intensity of the field being sufficient to cause atomization of the emerging liquid, the electrode comprising a core of conducting or semiconducting material contained in a tubular sheath, characterized in that the sheath has a wall and the volume resistivity of a section of the wall of said sheath which is 1 cm in length is within the range of $5\times10^{11}$ to $5\times10^{13}$ ohm cms.

3. The process according to claim 1, wherein the isocyanate has a viscosity in the range of 1 to 750 mPa.s and a volume resistivity in the range of $1\times10^{6}$–$1\times10^{11}$ ohm cms.

4. The process according to claim 3, wherein the isocyanate has a viscosity in the range of 1 to 300 mPa.s and a volume resistivity in the range of $5\times10^{6}$ to $5\times10^{9}$ ohm cms.

5. The process according to claim 4, wherein the isocyanate has a volume resistivity in the range of $5\times10^{7}$ to $5\times10^{8}$.

6. The process according to claim 1, wherein the isocyanate is applied to the paper substrate at a flow-rate of 0.5 to 75 g/minute/cm of nozzle width.

7. The process according to claim 6, wherein the flow rate is in the range of 1.5 to 30 g/minute/cm of nozzle width.

8. The process of claim 1, wherein the isocyanate is an aromatic isocyanate.

9. The process according to claim 8, wherein the isocyanate is selected from the group consisting of a polymeric MDI, an emulsifiable MDI, an MDI variant and mixtures thereof.

10. The process according to claim 9, wherein the isocyanate is an emulsifiable MDI.

11. The process of claim 1, wherein after the isocyanate is applied to the paper substrate, the paper substrate is heated at a temperature in the range of 65° to 205° C.

12. The process according to claim 2, wherein the isocyanate is applied to the paper substrate at a flow-rate of 0.5 to 75 g/minute/cm of nozzle width.

13. The process of claim 2, wherein the isocyanate is an aromatic isocyanate.

14. The process of claim 2, wherein after the isocyanate is applied to the paper substrate, the paper substrate is heated at a temperature in the range of 65° to 205° C.

15. The process according to claim 2, wherein the isocyanate has a viscosity in the range of 1 to 750 mPa.S and a volume resistivity in the range of $1\times10^{6}$–$1\times10^{11}$ ohm cms.

16. A process for treating a paper substrate as in claim 1, wherein said polyol has a molecular weight of 1500 to 10,000 and comprises an initiator having 1 to 18 carbon atoms.

17. A process for treating a paper substrate as in claim 1, wherein said polyol is an aliphatic tertiary amine-initiated polyol.

18. Process as in claim 17, wherein the concentration of nitrogen in the aliphatic tertiary amine initiated polyol is 0.002 to 0.02 eqN/100 g.

19. A process as in claim 17, wherein said aliphatic tertiary amine initiated polyol is prepared from a compound selected from the group consisting of ethylene diamine, triethylene diamine and triethanolamine.

20. A process as in claim 19, wherein the aliphatic tertiary amine initiated polyol is prepared from ethylene diamine.

21. A process as in claim 1, wherein the composition comprises 99 to 70% by weight of said isocyanate and 1 to 30% by weight of said isocyanate-reactive compound.

22. A process as in claim 20, wherein said ethylene diamine-based polyol has the following formula I:

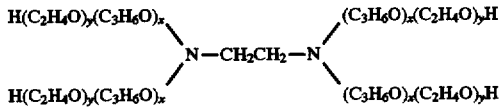

I

* * * * *